United States Patent [19]

Icaran

[11] 4,283,802

[45] Aug. 18, 1981

[54] TOILET TANKS WITH BUILT-IN WATER SUPPLY VALVE

[75] Inventor: Andres A. Y. Icaran, Monterrey, Mexico

[73] Assignee: Nacional de Ceramica, S.A., Monterrey, Mexico

[21] Appl. No.: 57,653

[22] Filed: Jul. 16, 1979

[51] Int. Cl.[3] ..... E03D 1/00; E03D 1/32

[52] U.S. Cl. ..... 4/353; 4/397; 4/417; 4/661; 137/434; 137/442; 137/444

[58] Field of Search ..... 4/417, 353, 397, 661; 137/434, 442, 444

[56] References Cited

U.S. PATENT DOCUMENTS

| | | | |
|---|---|---|---|
| 2,179,309 | 11/1939 | Tilden | 4/397 |
| 2,190,437 | 2/1940 | Teahen | 4/417 |
| 2,210,796 | 8/1940 | Crane | 4/397 |
| 2,359,701 | 10/1944 | Weaver | 4/417 |
| 2,449,948 | 9/1948 | Milne | 4/417 |
| 2,597,239 | 5/1952 | Goetz | 4/353 |
| 2,623,216 | 12/1952 | Gulick et al. | 4/397 |
| 2,794,445 | 6/1957 | Jannings | 137/434 |
| 3,860,972 | 1/1975 | Costello | 4/353 |

*Primary Examiner*—Henry K. Artis

*Attorney, Agent, or Firm*—Roylance, Abrams, Berdo & Farley

[57] ABSTRACT

A toilet tank has water supply and overflow ducts which are integrally formed with the base and walls of the tank. The water supply duct is connected to a water inlet at one end to supply water to the tank and has an inlet valve at its other end to control the supply of water to the tank. The overflow duct is open at its top to receive overflow water in the tank and is coupled to the toilet basin to pour the overflow water into the toilet basin.

10 Claims, 4 Drawing Figures

TOILET TANKS WITH BUILT-IN WATER SUPPLY VALVE

BACKGROUND OF THE INVENTION

This invention relates to a toilet tank in which the water inlet duct and overflow duct are integrally formed with the base and walls of the tank.

At the present time, there is in the market a large number of toilets with different features. All toilets have in common, a storage tank with fittings or valves which are used for water supply and discharge. These fittings are connected to the tank as attachments and are made out of plastic, bronze, aluminum, etc. This results in imperfect or faulty assemblies and causes break downs and constant water leaks. In spite of their small quantity, the leaks represent a considerable waste of water which is becoming an increasingly scarce and valuable element. Additionally, there are a considerable variety of such fittings, many of which do not fulfill their specific functions and may change the characteristics of the tank when they are installed or replaced. When the outlet valve is located higher than the inlet valve or viceversa, the required anti-siphoning function and the efficient operation of the toilet is prevented when the potable or drinking water supply is affected in a city by failures, breakdowns, improvements, etc., there is the possibility a vacuum may be created in the general supply line. During operation of the plumbing, the vacuum would cause a siphoning action in series which would result in the mixing of stagnant and drinking waters, thereby causing pollution. Such pollution can never take place in this type of toilet with parts that provide it with a siphoning action since such parts are built into the storage tank itself, can never be altered and consequently cannot be induced to modify its siphoning action.

Another feature or disadvantage that is common in conventional tanks is that several pipes for the correct conduction of water are attached as fixtures within the tanks. Several elements are added to the pipes to complete the mechanism, such as bolts, valves, levers, etc. Thus, the whole internal mechanism is attached to the tank resulting in the existence of many parts that do not always work efficiently after a certain time and usually corrode when they are made of metal.

SUMMARY OF THE INVENTION

Accordingly, it is an object of the present invention to overcome the aforementioned disadvantages by providing a toilet tank with unitarily formed or built in basic internal elements, such as the water inlet duct and the overflow duct.

Another object of the present invention is to provide a toilet tank which is easy and inexpensive to manufacture and maintain.

A further object of the present invention is to provide a toilet tank which will operate efficiently over an extended period of time.

The foregoing objects are attained by providing a toilet tank comprising a tank having unitary walls and base, and inlet duct formed as a unitary portion of one of the tank walls and having an inlet valve at an upper end thereof and means for coupling the inlet duct to a water supply at a lower end thereof, and an overflow duct formed as a unitary portion of one of the tank walls and having an open mouth at an upper end thereof at a predetermined position in the tank and means for connecting the overflow duct to a toilet basin at a lower end thereof.

By forming the toilet tank in this manner, the inlet and overflow ducts may be formed as a single unit so as to prevent wear and tear, and thereby increase the useful life of the tank. Additionally, since the ducts are formed as a single piece with the tank and have the same material as the tank, the ducts' position and dimensions may not be changed so that it is always in its most efficient configuration.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE PREFERRED EMBODIMENT OF THE INVENTION

Figure 4:
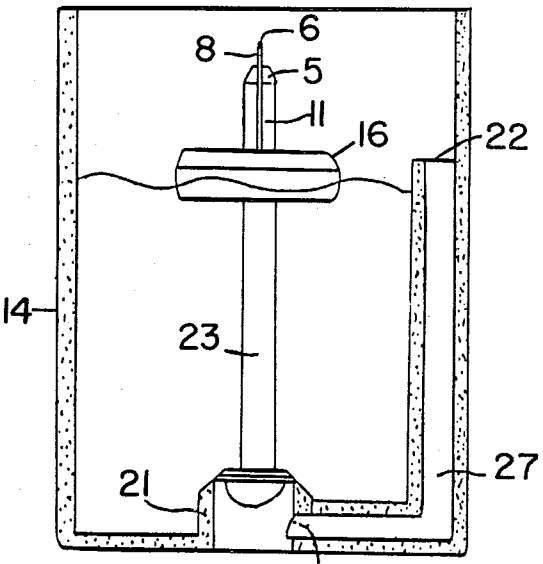
FIG. 4 is a side elevational view in cross-section of the toilet tank of FIG. 1.
Figure 3:
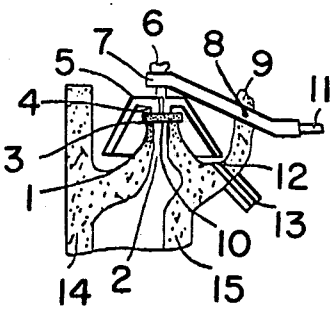
FIG. 3 is an enlarged elevational view in cross-section of the valve of FIG. 1 in its closed position.
Figure 1:
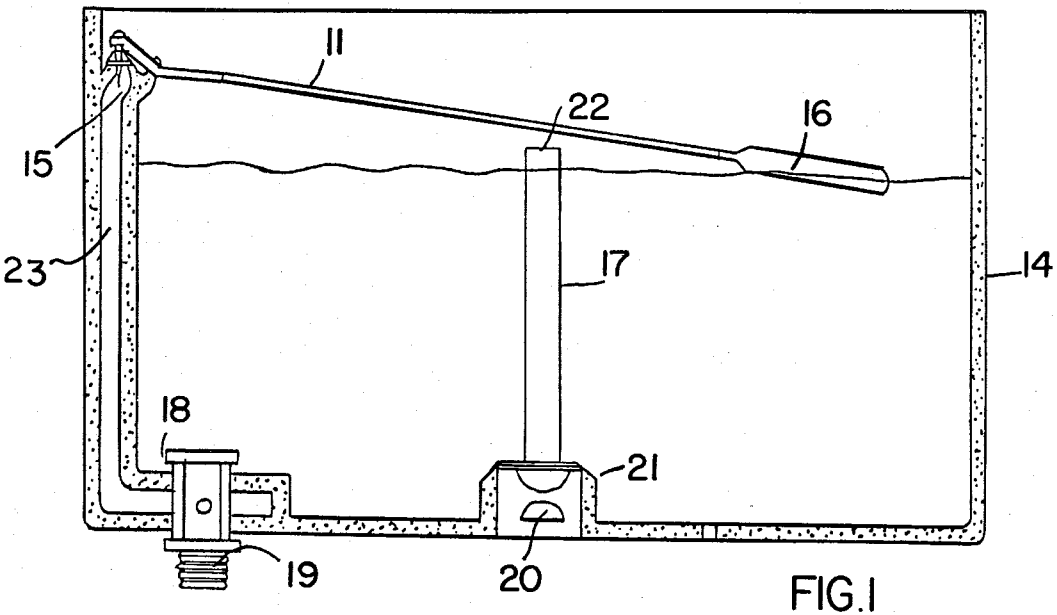
FIG. 1 is a front elevational view in cross-section in accordance with the present invention.
Figure 2:
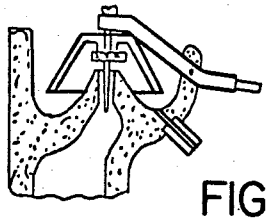
FIG. 2 is an enlarged elevational view in cross-section of the valve of FIG. 1 in its open position.

Referring to the drawings, the tank walls 14 have as a unitary thereof, two ducts. One duct 23 goes from its base where it is connected to the corresponding water inlet 18 by means of an attached threaded piece 19, up to the angle that is formed with one of the tank lateral faces, adopting therefore a bend of 90° to continue upwards along the surface of this face of the tank and, ending always at a higher point than the discharge or outlet duct. The duct ends with a slightly wider section which actually constitutes the body of the regulating valve 15 that lets water come into the tank. On the upper face of the valve there is a protuberance or projection 1 which is conically shaped with a bore 2 along its center. The bore 2 which communicates with the inside of the duct 23 and through which water flows into the tank. The bore 2, such orifice is closed once the tank is full by means of a piece which has the shape of a hemispherical cap or bell 5. The cap 5 is provided with a backing or support 4. Inside the center of the backing 4 is a packing 3 made of rubber or another adequate material. A guide 10 which is in the shape of a bar stems from the backing 4. In the closed position of cap 5, the guide 10 is inserted precisely through the bore 2 of duct 23 to set the cap or bell 5 in proper position and consequently the sealing pack 3 is located exactly over the bore 2. The cap or bell 5 moves up and down or viceversa, due to the water pressure and is guided precisely by the guide 10 which moves in the same direction. This movement of the guide 10 prevents accumulation of incrustations or other particles on the walls of the bore 2 to keep it completely clean at all times. This allows water to flow always without difficulty through the bore 2, without any risk of plugging since it will be cleaning itself automatically with every movement of the cap 5 and its guide 10.

The body of this valve, 15 on the side that faces the center of the tank has an orifice 13. The orifice 13 communicates with the inside of the tank. An ear 9 is located directly above the orifice 13. The ear 9 has a bore to which a lever or actuating arm 7 is connected. The lever 7 is precisely inserted in the ear 9 and is attached thereto by means of a pin 8 so that the lever or arm 7 shall have a rocking movement. The travel of the O lever or arm 7 is limited in one direction by its contact against cap 5 which covers the bore 2 of the valve 15. In the other direction movement is limited when it leans against the ear 9 that supports it. The end of the lever or actuating arm 7 that leads to the center of the tank is connected to a rod or bar 11. The opposite end of the rod or bar 11 is in turn connected to a float or air chamber 16. When the tank is empty, the float 16 will tend to go down lifting up the opposite end of the lever or arm 7 to lift, with the upward water pressure in duct 23, the cap or bell 5 along with its sealing pack 3 and guide 10. This permits water to be discharged into the tank in a uniform manner, since cap or bell 5 distributes the water in a circular manner and prevents splashing could make water come out through the upper cover of the tank.

Once the water has reached its normal level, float 16 which has consequently been pushed upwards by the force of water, causes the lever or actuating arm 7 lean its end against the cap or bell of valve 5. This causes the packing 3 to press against top of bore 2 to cut off the water supply until the tank contents are again discharged and another cycle as the one previously described begins. It should be noted that contact between lever or actuating arm 7 and valve cap 5 can be adjusted by means of a screw 6 that appears on the former. The screw 6 allows an anticipated or retarded contact, depending on the adjustment of the screw in its hole, thus premitting closing up the valve at different water levels.

On another of the tank faces there is a vertical overflow duct 17 which is built into the tank itself and forms an integral or unitary part thereof. Its upper mouth or opening 22 is located below the position of the bore 2 of the supply or inlet duct 23. On the tank bottom, the duct 17 makes a 90° curve to continue along the bottom until it makes contact with vertical wall 21 of discharge orifice of the toilet. Through the mouth 20, the duct 17 communicates with the toilet basin, whether the mouth of the discharge orifice is opened or closed.

In this manner, the overflow duct 17 can collect overflow water through its upper mouth 22. The height of the duct 17 is pre-set to operate under the best conditions. The water that may exceed the level previously established, due to some defficiency in the closing of inlet valve 15, may pass directly to the toilet basin through the lower communication with the discharge orifice to prevent flooding.

While a particular embodiment has been chosen to illustrate the invention, it will be understood by those skilled in this art, that various changes and modifications can be made therein without departing from the scope of the invention as defined in the appended claims.

What is claimed is:

1. A toilet tank comprising a tank having unitary walls and base;

an inlet duct formed as a unitary portion of one of said tank walls, said inlet duct having an inlet valve at an upper end thereof and means for coupling said inlet duct to a water supply at a lower end thereof, said inlet valve having a valve seat formed as a unitary portion of said upper end of said inlet duct with a bore therethrough which communicates with the inside of said inlet duct; and an overflow duct formed as a unitary portion of one of said tank walls; said overflow duct having an open mouth at an upper end thereof at a predetermined position in said tank and means for connecting said overflow duct to a toilet basin at a lower end thereof.

2. A toilet tank according to claim 1, wherein said inlet valve comprises a moveable portion having a cap means moveable between an open position spaced from said valve seat to permit passage of fluid through said bore and a closed position in contact with said valve seat to close said bore preventing passage of fluid therethrough.

3. A toilet tank according to claim 2, wherein said valve seat comprises a conical protuberance extending from said upper end of said inlet duct coaxially with said bore.

4. A toilet tank according to claim 2, wherein said cap means has a bar member extending therefrom which is slidably received in said bore when said cap means moves towards said closed position to guide movement of said cap means and to clean said bore.

5. A toilet tank according to claim 2, wherein said cap means is hemispherically shaped.

6. A toilet tank according to claim 2, wherein said cap means has a sealing pack means on a surface thereof facing said bore for preventing water from passing through said bore when said cap means is in said closed position.

7. A toilet tank according to claim 2, wherein an actuating lever arm is mounted in said tank and has a float coupled to one end thereof and said cap means coupled to an opposite end thereof, said arm being pivotally mounted between said cap means and said float.

8. A toilet tank according to claim 7, wherein said cap means is adjusably coupled to said arm to permit adjustment of water level in said tank.

9. A toilet tank according to claim 8, wherein said cap means is coupled to said arm by an adjustable screw.

10. A toilet tank according to claim 1, wherein said valve seat comprises a conical protuberance extending from said upper end of said inlet duct coaxially with said bore.

* * * * *